US005545876A

United States Patent [19]

Park

[11] Patent Number: 5,545,876

[45] Date of Patent: Aug. 13, 1996

[54] APPARATUS AND METHOD FOR MEASURING ELECTRIC POWER CONSUMED IN ELECTRICAL HEATERS

[75] Inventor: Joung I. Park, Seoul, Rep. of Korea

[73] Assignee: Goldstar Co., Ltd., Seoul, Rep. of Korea

[21] Appl. No.: 307,211

[22] Filed: Sep. 16, 1994

[30] Foreign Application Priority Data

Sep. 16, 1993 [KR] Rep. of Korea ..... 1993-18621

[51] Int. Cl.[6] ..... H05B 1/02

[52] U.S. Cl. ..... 219/492; 219/497; 219/508; 219/486; 219/485; 219/505; 219/481

[58] Field of Search ..... 219/492, 491, 219/497, 499, 501, 483, 485, 486, 508, 505, 481; 307/39–41

[56] References Cited

U.S. PATENT DOCUMENTS

| | | | |
|---|---|---|---|
| 4,687,910 | 8/1987 | Aoshima et al. | 219/506 |
| 4,695,710 | 9/1987 | Yamashita et al. | 219/506 |
| 4,720,623 | 1/1988 | DiCesare et al. | 219/497 |
| 4,943,706 | 7/1990 | Lyall et al. | 219/494 |
| 5,189,283 | 2/1993 | Carl, Jr. et al. | 219/497 |

*Primary Examiner*—Mark H. Paschall
*Attorney, Agent, or Firm*—Spencer & Frank

[57] ABSTRACT

This Measuring Method of the electric power consumption of the Inverter Cooker enables automatic measurements of the electric power consumption for the keep-warm function, whether actual keep-warm temperature is set somewhat higher or lower, so that the productivity of the Cooker will be improved and judgement for defects of the keep-warm heaters made easier. The method comprises; firstly step to clear the 1st and 2nd timers and to check input of the measuring key of the power consumption; if when input of the measuring key is detected, step to heat the top-heater through the 1st timer up to the 1st set-time and to measure at this point the power consumption to judge whether there is an abnormal state in the top-heater; when the 1st set-time elapses, step to heat the top and side-heaters for the period up to the 2nd set-time and to measure at this point the power consumption to check whether there is defect in the side-heater; when the 2nd-set time elapses, step to suspend heating of the top and side-heaters and detect the keep-warm temperature up to that time and compare to the reference temperature; and step to heat up the top and side heaters in case when the keep-warm temperature is found lower than the reference, and to suspend heating when the keep-warm temperature is higher.

14 Claims, 3 Drawing Sheets

APPARATUS AND METHOD FOR MEASURING ELECTRIC POWER CONSUMED IN ELECTRICAL HEATERS

FIELD OF INVENTION

This invention relates to inverter cooker, more particularly to apparatus and method for measuring electric power consumed in invertor cooker in their assembly production, to measure automatically, swiftly and precisely electric power consumption for keep-warm function and determine definitely whether keep-warm heater operates in normal state.

BACKGROUND OF THE INVENTION

Generally, the inverter cooker operates in the sequence of rice-cooking, steam-settle-down and keep-warm functions and fulfil the functions to cook the rice and keep it warm at a fixed temperature.

Among them, the most important is keep-warm function which keeps the cooked rice warm at a fixed temperature. For example, in case keep-warm function does not maintain the fixed temperature, the cooked rice will have different flavor in the sealed container of the cooker and it is difficult to keep the cooked rice for an extended period of time. In order to prevent occurrence of these problems, line operator in the assembly production has to measure electric power consumption for the keep-warm function and determine whether the keep-warm heater is normal or not to cope with these situations.

For the method of measuring the electric power consumption of keep-warm function of the above inverter cooker in the production, line operator is to directly heat up top-heater and side-heater to a certain temperature and keeps waiting for the keep-warm temperature to drop below a reference temperature. As soon as the keep-warm temperature drops below the reference temperature during the period of keep-warm, the line-operator had to measure with power meter power consumption of the keep-warm heaters to judge abnormal state of the heaters. In case the keep-warm is set at a higher temperature, the operator had to wait longer until it reaches to the reference temperature, accordingly enforcing waste of time and deteriorating productivity.

SUMMARY OF THE INVENTION

The object of this invention is to provide measuring method and apparatus of the electric power consumption of the inverter cooker, by which the measurements of the electric power consumption for the keep-warm function can be made automatically, swiftly and precisely, whether actual keep-warm temperature is somewhat set higher or lower, so that productivity of the cooker can be improved and defects of the keep-warm heaters can be easily detected.

The object of this invention can be achieved by the measuring method of electric power consumption of the Inverter Cooker which comprises firstly, step to clear the 1st and 2nd timers and to check input state of the measuring key of the power consumption, if in case input state of the measuring key is detected, step to heat the top heater through the 1st timer up to the 1st set-time and to measure at this point the power consumption to judge whether there is abnormal state in the top-heater, when the 1st set-time elapses, step to heat the top and side-heaters for the period to the 2nd set-time and to measure at this point the power consumption to check whether there is defect in the side-heater, when the 2nd-set time elapses, step to suspend heating of the top and side heaters and detect the keep-warm temperature up to that time and compare/refer to the reference temperature and step to heat up the top and side heaters in case when the keep-warm temperature is lower than the reference, and to suspend heating when the keep-warm temperature is higher.

Other object of this invention can be achieved by providing a apparatus comprising measuring key member of the power consumption which detects state of power consumption measurement of the keep-warm heaters, on selection of measuring key member, means to generate keep-warm control times, which counts with a fixed time interval and generates the 1st and 2nd set-times, detection member of the keep-warm temperature which detects temperature of the keep-warm heaters and converts to a corresponding electric signal output, voltage comparing means which compares the voltage corresponding to temperature detected by the detection member-of the keep-warm temperature, to the reference voltage, and outputs a resulting voltage; means of logic combination to combine logically the resulting voltage from the voltage comparing means and the 1st and 2nd set-times generated with the fixed time interval by the creation means of keep-warm control times, and to output heating control signals for the keep-warm heaters in a fixed sequence and switching member to heat the top and side heaters on and off with the intervals according to the heating control signals output by the logic combination means in the fixed sequence.

BRIEF DESCRIPTION OF THE DRAWINGS

FIG. 3 timing graph of the power consumption according to the signals of keep-warm control in FIG. 2;

DETAILED DESCRIPTION OF THE INVENTION

Figure 1:
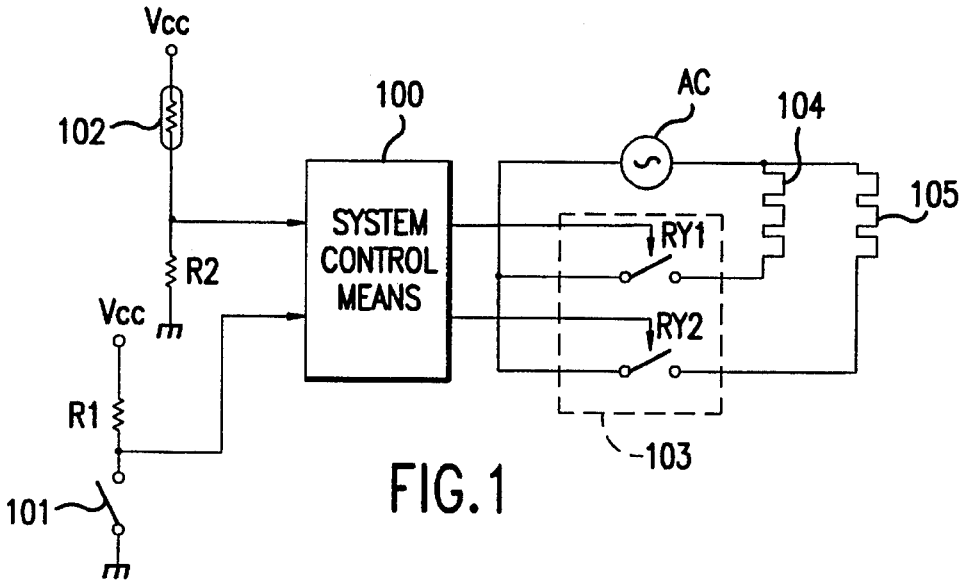
FIG. 1 is schematic diagram for electric power consumption measurement system of the Inverter Cooker of this invention.

FIG. 1 is schematic diagram of the measuring system for electric power consumption of the Inverter Cooker of this invention, which includes as shown in the figure; key member 101 of the power consumption measurement which detects presence of power consumption measurement of the keep-warm heaters; detection member 102 of the keep-warm temperature which detects heating temperature of the said keep-warm heaters and converts to a corresponding electric signal output; system control means 100 which logically operates key signal from the above key member 101 of the power consumption measurement and keep-warm temperature from detection member 102 of the keep-warm temperature, and outputs heating control signals for the keep-warm heaters in a fixed sequence; and switching member 103 to heat the top heater 104 and side heater 105 on and off with the interval according to the heating control means 100.

Figure 2:
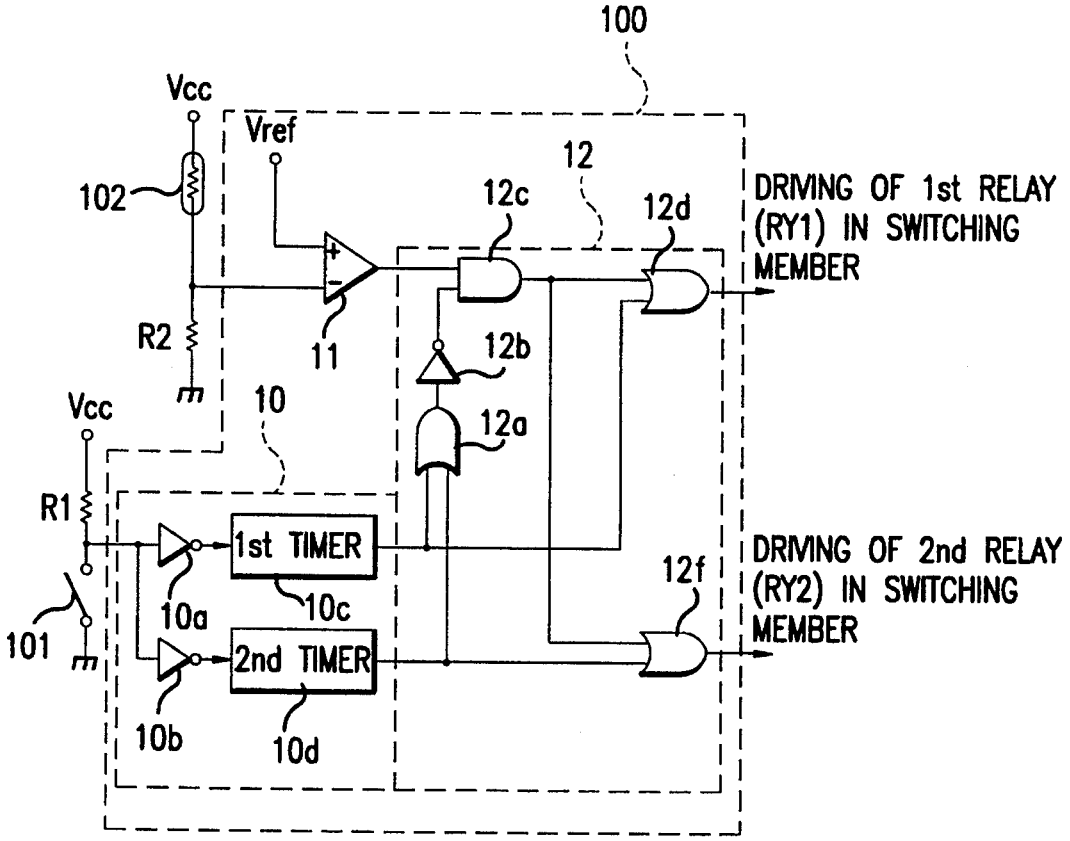
FIG. 2 is detailed circuit diagram of system control means of FIG. 1.

The above system control means includes as shown in FIG. 2; on selection of the above key member 101 of power consumption measurement, means 10 to generate keep-warm control times, which count with a fixed time interval and generate the 1st and 2nd set-times; voltage comparing means 11 which compares voltage corresponding to temperature detected by the above detection member 102 of the keep-warm temperature, to the reference voltage (Vref) and outputs a resulting voltage; means of logic combination 12 to combine logically the resulting voltage from the above voltage comparing means 11 and the 1st and 2nd set times generated with the fixed time interval by the creation means 10 of keep-warm control times, and to output heating control signals for the keep-warm heaters in a fixed sequence which control switching member 103.

The aforesaid means 10 of generating keep-warm control times includes; the 1st and 2nd invertors 10*a* and 10*b* which invert key signals respectively from the above measuring key 101, and the 1st and 2nd timers 10*c* and 10*d* which become enable and disable according to the signals from the 1st and 2nd inverters 10*a* and 10*b* and count up to preset times respectively. And the above means of logic combination 12 includes; the 1st OR gate 12*a* and the 3rd invertor 12*b* which perform OR-gating and then inverting of the counter outputs from the 1st and 2nd timers 10*c* and 10*d*; AND gate 12*c* which performs AND-gating of signal from the above the 3rd invertor 12*b* and output signal from the voltage comparison means 11; the 2nd OR-gate 12*d* which performs OR-gating output signal from the AND-gate 12*c* and the 1st set-time by the 1st timer 10*c*, and by the resulting signal thereof controls heating of the top heater 104 through switching member 103; and the 3rd OR-gate 12*f* which performs OR-gating output signal from the AND-gate 12*c* and the 2nd set-time by the 2nd timer 10*d* and by the resulting signal thereof controls heating of the side heater 105 through switching member 103. In the drawing, symbols not explained are resisters of R1 and R2 and AC is alternate supply power to the top and side heaters of 104 and 105.

Operation and effects for the Inverter Cooker equipped with as above are described hereunder;

In production, when the line operator initially turn on power-switch(not shown in the drawing), terminal voltage of the power supply(Vcc) is made inverse to low signals through the 1st and 2nd inverters 10*a* and 10*b* of the generating means of keep-warm control times 10 in the system control means 100, which then clear the timers 10*c* and 10*d*. In this state, when the operator turns on key member 101 of the power consumption measurement to measure the power consumption, the above-said supply terminal voltage (Vcc) bypasses through resister R1 and the key member 101 and produces low inputs to the 1st and 2nd inverters 10*a* and 10*b* of the generation means of keep-warm control times 10.

Figure 3A:
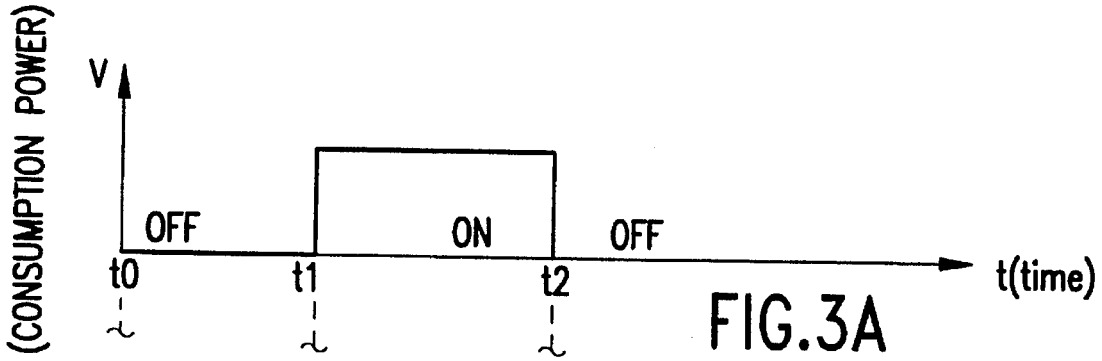
FIG. 3(A) is timing graph of on-off driving of the side heater.
Figure 3B:
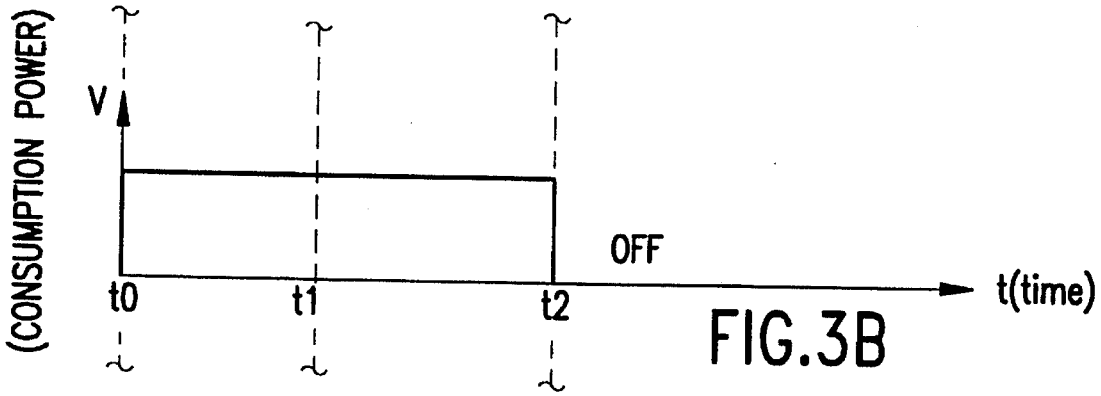
FIG. 3(B) is timing graph of on-off driving of the top heater.
Figure 3C:
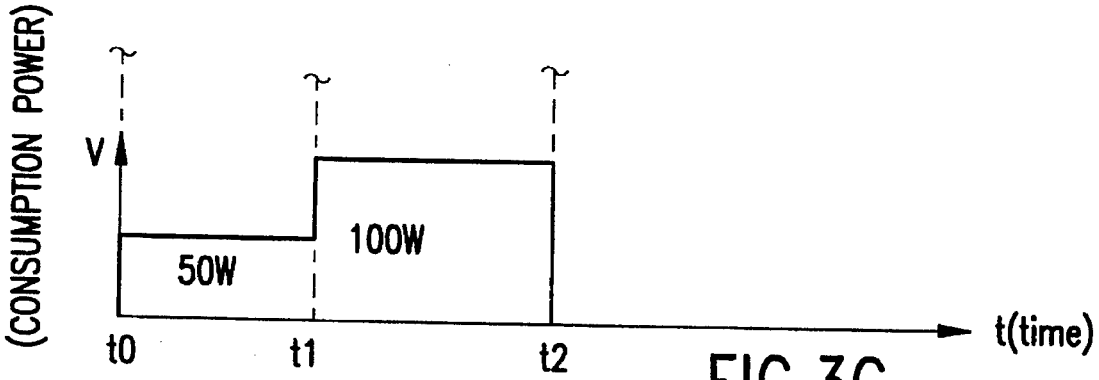
FIG. 3(C) is wave form graph of power consumption measurement of the side and top heaters.
Figure 4:
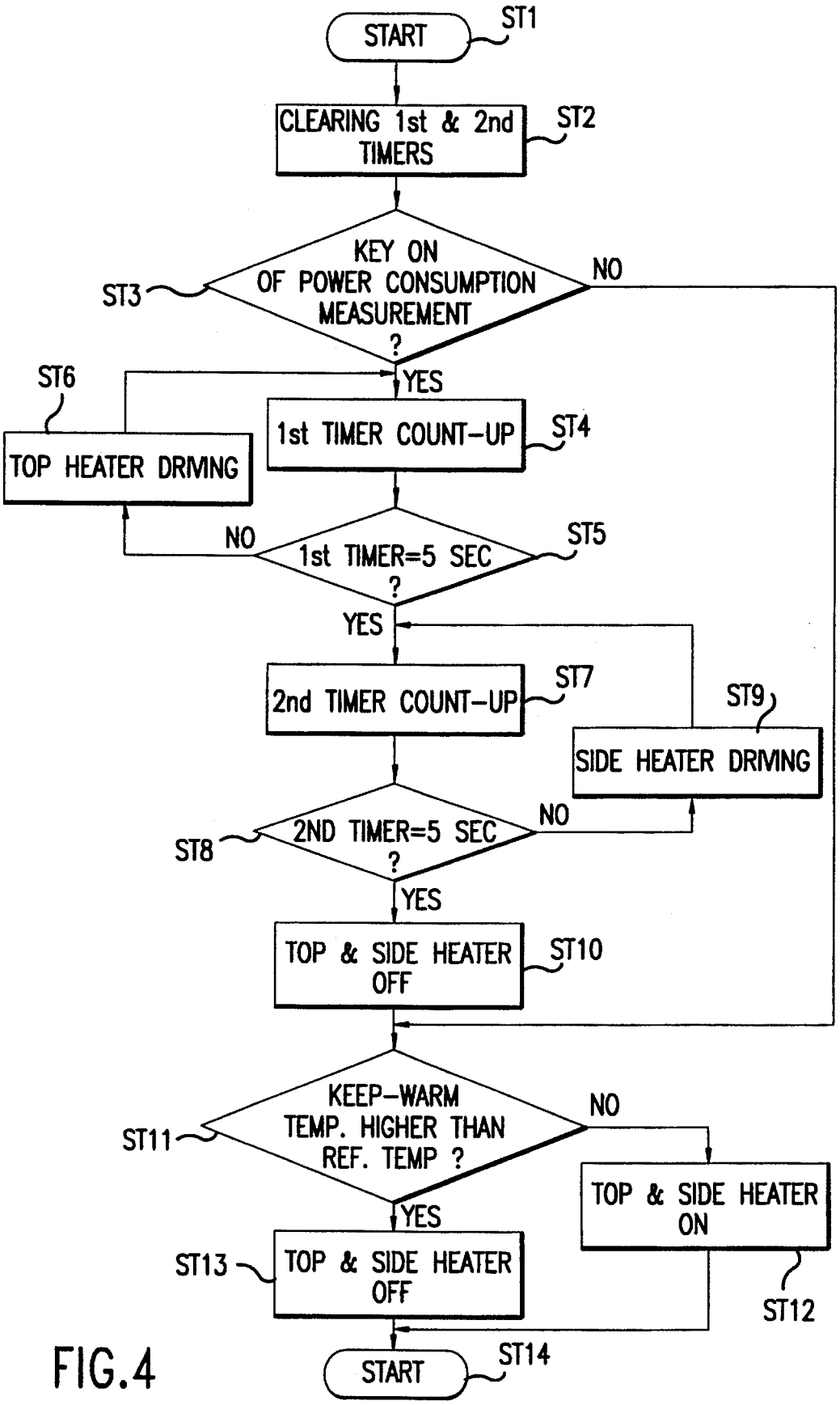
FIG. 4 is signal flow chart for operation description of FIG. 1.

Then the 1st and 2nd invertors 10*a* and 10*b* inverts these low signals to high signals and enable the 1st and 2nd timers 10*c* and 10*d*. As soon as the 1st timer 10*c* is made enable by the 1st invertor 10*a*, the timer performs count up from time to when key member 101 of the power consumption measurement turned on, to the 1st set-time of t2, and produces high pulse as shown in FIG. 3(C). When the 1st-set time (t2) elapses, it produces low pulse and provides input to the 1st and 2nd OR gates 12*a* and 12*d* of the logic combination means 12. Accordingly 2nd OR gate 12*d* of the logic combination means 12, regardless of the output signal from the voltage comparing means 11 that is, the keep-warm temperature detected by the detection member 102 of the keep-warm temperature which is to be fed through other side input terminal, energizes the 1st relay(RY1) of the switching member 103 and heats the top heater 104 for period up to the 1st set-time(t2). During the 1st set-time(t0–t2), the operator can measure power consumption(50 W) for heating the top heater 104 as shown FIG. 3(C) and judge whether there is abnormal state and whether the power is normally supplied during the keep-warm function. Afterward, the 2nd timer 10*d* of the creation means of keep-warm control times counts up after a certain period—when 5 seconds elapse by the 1st timer(10*c*)- to the 2nd set time(t1) and produces high pulses in FIG. 3(A). When the 2nd-set time(t1) elapses, it produces low pulse and provides input to the 1st and 3rd OR gates 12*a* and 12*f* of the logic combination means 12. Accordingly 3rd OR gate 12*f* of the logic combination means 12, regardless of the keep-warm temperature detected by the detection member 102 of the keep-warm temperature which is fed through other input terminal, energizes the 1st relay(RY2) of the switching member 103 and heats the top heater 104 for period up to the 2nd-set time(t1). During this 2nd set-time(t0–t1), the operator can measure power consumption(100 W) for heating the side heater 105 as shown FIG. 3(C) and judge whether there is abnormal state and whether the power is normally supplied during the keep-warm function. When the 1st and 2nd set-times (t2) and (t1) of the 1st and 2nd timers elapse, the 1st and 2nd OR gates 12*d* and 12*f* produces low singnals, which then cut off the 1st and 2nd relays (RY1) and (RY2), suspending heating of the top and side heaters 104 and 105. After the top and side heaters 104 and 105 are turned off and when key member of the power consumption measurement 101 is turned off, the 1st and 2nd timers 10*c* and 10*d* become disabled and output low pulses. The low pulses produced by the above 1st and 2nd timers 10*c* and 10*d* are logically added by the 1st OR gate 12*a* of the logic combination means 12 and are inverted to high signal at the 3rd invertor 12*b* and fed to No. 1 input terminal of the AND gate 12*c*. At this step, the detection member 102 of the keep-warm temperature detects keep-warm temperature produced after heating the top and side heaters 104 and 105, and provides input of corresponding electric signal to inverting terminal(–) of the voltage comparison means 11. The above voltage comparison means 11 compares the reference voltage(Vref) which is fed to non-inverting terminal, to the keep-warm temperature fed to the inverting terminal(–). When comparison result shows the keep-warm temperature detected by the detection member 102 of the keep-warm temperature higher than the reference, it produces low signal, and when the keep-warm temperature lower than the reference, produces high signal, and feed these signals to other side input terminal of the AND gate 12*c*. Accordingly, when the keep-warm temperature is lower than the reference, that is, the voltage comparison means 11 produces high signal, the AND gate 12*c* performs logical-product with high signal output from the 3rd invertor 12*b* and produces high signal. This high signal from the above AND gate 12*c* turns on the top and side heater 104 and 105 at the same time through the 2nd and 3rd OR gates 12*d* and 12*f*. And when the keep-warm temperature is higher than the references that is, the voltage comparison means 11 produces low signal, the AND gate produces low signal regardless output from the 3rd invertor 12*b*, which is to turn off heating of the top and side heaters 104 and 105 at the same time. As described above, this invention make it possible to measure automatically, swiftly and precisely the electric power consumption during the keep-warm operation of the Cooker during their assembly production, whether actual keep-warm temperature is somewhat higher or lower, so as to judge whether there is abnormal state in the top and side heaters and whether the power is normally supplied, thus increasing productivity of the cooker and effecting easy-judgement of defect of the keep-warm heaters.

What is claimed is:

1. A method of measuring electrical power consumption by an inverter cooker including a top heater, a side heater, first and second timers and a power consumption measuring key, said cooker sequentially performing rice-cooking, steam-settle-down and keep-warm functions, said method comprising the steps of:

(a) clearing said first and second timers;

(b) checking said power consumption measuring key for an input state;

(c) when a measuring key input is detected in step (b), heating the top heater for a first predetermined time, measuring power consumption by the top heater for the first predetermined time, and judging whether there is an abnormal state in the top heater;

(d) heating the top and side heaters for a second predetermined time, measuring power consumption by the top and side heaters during the second predetermined time, and judging whether there is an abnormal state in the side heater;

(e) at the end of said first and second predetermined times, putting said cooker in a keep-warm state, detecting the keep-warm temperature, and comparing said keep-warm temperature to a reference keep-warm temperature;

(f) heating the top and side heaters when said keep-warm temperature is lower than the reference temperature, and stop heating the top and side heaters when said keep-warm temperature is higher than the reference temperature.

2. The method of claim 1, wherein step (c) includes initiating counting said first predetermined time when said power consumption measuring key is selected.

3. The method of claim 1, wherein step (d) includes initiating counting said second predetermined time before said first predetermined time elapses.

4. The method of claim 3, wherein counting of said second predetermined time is initiated when one-half of said first predetermined time elapses.

5. The method of claim 1, wherein step (c) includes setting said first predetermined time at 10 seconds.

6. The method of claim 1, wherein step (d) includes setting said second predetermined time at 5 seconds.

7. The method of claim 1, wherein step (d) includes measuring power consumption when there is no measuring key input and the keep-warm temperature is lower than the keep-warm reference temperature.

8. An apparatus for measuring electric power consumption by an inverter cooker which sequentially performs rice-cooking, steam-settle-down and keep-warm functions comprising:

(a) means including a power consumption measuring key member for detecting power consumption of top and side keep warm heaters;

(b) means responsive to said power consumption measuring key member for detecting the temperature of the keep-warm heaters, and generating an electric signal output corresponding to the temperature of the keep-warm heaters;

(c) means, including a control system operating logically on a signal from said power consumption measuring key member and said keep-warm temperature signals, for outputting heating control signals for the keep-warm heaters in a fixed sequence; and (d) means including a switching member for heating the top and side heaters on and off in response to said heating control signals.

9. The apparatus of claim 8, wherein the system control means further comprises upon selection of the power consumption measuring key member, means for generating keep-warm control times to provide fixed time intervals and for generating 1st and 2nd set-times; means for comparing the voltage corresponding to the temperature of the keep-warm heaters to a reference voltage, and for producing a resulting output voltage; and means for logically combining (1) said resulting output voltage from said comparing means and (2) said 1st and 2nd set-times generated with said fixed time intervals, and to output heating control signals for the keep-warm heaters in a fixed sequence, and to heat the top and side heaters on and off at intervals in accordance with said heating control signals.

10. The apparatus of claim 9, wherein 1st and 2nd inverters invert respectively key signals from said power consumption measuring key; and 1st and 2nd timers become enabled and disabled in response to the output signals from the 1st and 2nd inverters and count up to preset times, respectively.

11. The apparatus of claim 10, wherein said logically combining means comprises a 1st OR gate and a 3rd inverter which perform logical adding and inverting of counter outputs of the 1st and 2nd-set-times from 1st and 2nd timers, an AND-gate for gating the output of said comparing means and said 3rd inverter, and 2nd and 3rd OR-gates for performing logical adding of output signals from the AND-gate and the 1st and 2nd-set-times of the 1st and 2nd timers, whereby the resulting signals control heating of the top and side heaters.

12. The apparatus of claim 9 wherein said means for generating keep-warm control times counts by the 1st timer and generates the 1st-set-time at the same time the power consumption measuring key is selected.

13. The apparatus of claim 9, wherein said means for generating keep-warm control times counts by the 2nd timer and generates the 2nd-set-time when ½ of the 1st-set-time elapses.

14. An apparatus for measuring electrical power consumption by an inverter cooker which sequentially performs rice-cooking, steam-settle-down and keep-warm functions comprising:

(a) means including a power consumption measuring key member for detecting power consumption of top and side keep warm heaters;

(b) means including first and second timers for defining first and second predetermined times;

(c) means for clearing said first and second timers;

(d) means for checking said measuring key for an input state;

(e) means responsive to a detected input state by said measuring key for heating the top heater for a first predetermined time, measuring power consumption for the first predetermined time, and judging whether there is an abnormal state in the top heater;

(f) means for heating the top and side heaters for a second predetermined time, measuring power consumption by the top and side heaters during the second predetermined time, and judging whether there is an abnormal state in the side heater;

(g) means responsive to the end of said first and second predetermined times for putting said cooker in a keep warm state, detecting the keep-warm temperature, and comparing said keep-warm temperature to a reference keep-warm temperature; and (h) means for heating the top and side heaters when the keep-warm temperature is lower than the reference temperature, and for stopping heating the top and side heaters when the keep-warm temperature is higher than the reference temperature.

* * * * *